US009544073B2

(12) United States Patent
Bouazizi

(10) Patent No.: US 9,544,073 B2
(45) Date of Patent: Jan. 10, 2017

(54) SYSTEM AND METHOD FOR DELIVERING NOTIFICATION MESSAGES

(75) Inventor: Imed Bouazizi, Tampere (FI)

(73) Assignee: Nokia Technologies Oy, Espoo (FI)

( * ) Notice: Subject to any disclaimer, the term of this patent is extended or adjusted under 35 U.S.C. 154(b) by 857 days.

(21) Appl. No.: 12/867,750

(22) PCT Filed: Feb. 13, 2009

(86) PCT No.: PCT/IB2009/050615

§ 371 (c)(1),
(2), (4) Date: Mar. 15, 2011

(87) PCT Pub. No.: WO2009/101602

PCT Pub. Date: Aug. 20, 2009

(65) Prior Publication Data

US 2011/0161442 A1 Jun. 30, 2011

Related U.S. Application Data

(60) Provisional application No. 61/029,099, filed on Feb. 15, 2008.

(51) Int. Cl.

| | |
|---|---|
| ***H04H 20/93*** | (2008.01) |
| ***H04H 60/91*** | (2008.01) |
| *H04H 20/59* | (2008.01) |

(52) U.S. Cl.

CPC ..... *H04H 20/93* (2013.01); *H04H 60/91* (2013.01); *H04H 20/59* (2013.01); *H04H 2201/37* (2013.01)

(58) Field of Classification Search

CPC ..... H04H 20/93
USPC ..... 709/206
See application file for complete search history.

(56) References Cited

U.S. PATENT DOCUMENTS

| | | | | |
|---|---|---|---|---|
| 7,733,820 | B2 * | 6/2010 | Choi et al. | 370/312 |
| 7,801,513 | B2 * | 9/2010 | Jung et al. | 455/414.2 |
| 8,055,284 | B2 * | 11/2011 | Jeon | H04H 60/25 455/450 |
| 8,064,885 | B2 * | 11/2011 | Hwang et al. | 455/412.2 |
| 8,103,209 | B2 * | 1/2012 | Jung et al. | 455/3.01 |
| 8,368,530 | B1 * | 2/2013 | Zhang | H04W 76/007 340/506 |
| 2003/0235278 | A1 * | 12/2003 | Paila | H04L 12/587 379/88.13 |

(Continued)

FOREIGN PATENT DOCUMENTS

| | | |
|---|---|---|
| EP | 1753166 | 2/2007 |

OTHER PUBLICATIONS

"RFC 3926—FLUTE—File Delivery over Unidirectional Transport", Network Working Group, Oct. 2004, 35 pages.*

(Continued)

*Primary Examiner* — Jerry Dennison
(74) *Attorney, Agent, or Firm* — Banner & Witcoff, Ltd.

(57) ABSTRACT

A method includes receiving at least an indication of a notification message through a first channel and receiving at least a part of the notification message through a second channel. The receiving at least an indication of a notification message may include a push-type delivery, and the receiving at least a part of the notification message may include a pull procedure. Alternatively, the receiving at least an indication of a notification message may include a poll-type delivery, and the receiving at least a part of the notification message may include a pull procedure.

18 Claims, 7 Drawing Sheets

(56) References Cited

U.S. PATENT DOCUMENTS

2006/0221882 A1* 10/2006 Jung et al. ..... 370/312
2007/0036102 A1* 2/2007 Hwang ..... H04H 20/93 370/328
2007/0042757 A1* 2/2007 Jung ..... H04W 4/06 455/412.2
2007/0124359 A1* 5/2007 Hwang ..... H04H 60/04 709/200
2007/0207727 A1* 9/2007 Song et al. ..... 455/3.06
2008/0040760 A1* 2/2008 Cho ..... H04N 21/4331 725/87
2008/0045251 A1* 2/2008 Jeon ..... H04H 60/25 455/466
2008/0090513 A1* 4/2008 Collins et al. ..... 455/3.01
2008/0107057 A1* 5/2008 Kannan et al. ..... 370/312
2008/0242370 A1* 10/2008 Lando ..... H04L 12/581 455/574
2009/0075584 A1* 3/2009 Jung et al. ..... 455/3.01
2009/0083794 A1* 3/2009 Lee ..... H04H 20/93 725/39
2009/0182827 A1* 7/2009 Bouazizi ..... 709/206
2009/0210510 A1* 8/2009 Bouazizi ..... 709/207
2009/0210896 A1* 8/2009 Song ..... H04H 60/72 725/32
2009/0253416 A1* 10/2009 Lee et al. ..... 455/414.1
2009/0310566 A1* 12/2009 Xu ..... H04W 72/005 370/331
2009/0319849 A1* 12/2009 Burklin ..... H04L 1/1809 714/748
2010/0011088 A1* 1/2010 Gautier ..... H04L 1/1809 709/217
2010/0138869 A1* 6/2010 Li ..... H04H 60/39 725/54
2010/0151782 A1* 6/2010 Sato ..... H04H 60/13 455/3.01
2010/0250633 A1* 9/2010 Hannuksela et al. ..... 707/825
2011/0010737 A1* 1/2011 Bouazizi et al. ..... 725/34
2011/0161442 A1* 6/2011 Bouazizi ..... 709/206
2011/0179378 A1* 7/2011 Wheeler et al. ..... 715/780

OTHER PUBLICATIONS

"RFCC 1945—Hypertext Transfer Protocol—HTTP/1.0", Network Working Group, May 1996, 60 pages.*
Patent Examination Report No. 1 for AU2009213729, dated Nov. 12, 2012.
Official Communication in EP 09 709 869.3-1224 dated Nov. 18, 2011.

* cited by examiner

SYSTEM AND METHOD FOR DELIVERING NOTIFICATION MESSAGES

BACKGROUND OF THE INVENTION

The present invention relates generally to the wireless communication. More particularly, the present invention relates to the delivering of notification messages in association with digital video broadcasting.

Current efforts are underway to define a notification framework for IP datacast over Digital Video Broadcasting for Handhelds (DVB-H). The notification framework enables the delivery of notification messages, informing receivers and users about certain events quickly. Notification messages can either be synchronized to some audio/visual content, or they can be a stand-alone service. Synchronized notification messages describe events that are related to some A/V service, such as requests for voting or contextual advertisements. Stand-alone notification services carry notification messages that are grouped by certain criteria but are not related to an A/V service. An example of standalone notification services is a stock market ticker that delivers share prices.

Further, notification services may be default or user selected. Default notification messages may be of interest to all receivers and, hence, expected to be received automatically. An example of default notification services is an emergency notification service. On the other hand, user-selected notification messages are only received upon user selection. Depending on the type of the notification service, the delivery of the notification messages may differ.

SUMMARY OF THE INVENTION

In one aspect of the invention, a method includes receiving at least an indication of a notification message through a first channel and receiving at least a part of the notification message through a second channel.

In one embodiment, the receiving at least an indication of a notification message includes a push-type delivery, and the receiving at least a part of the notification message includes a pull procedure. In an alternative embodiment, the receiving at least an indication of a notification message includes a poll-type delivery, and the receiving at least a part of the notification message includes a pull procedure.

In one embodiment, the receiving at least an indication of a notification message includes receiving only an indication of an availability of the notification message.

The receiving at least a part of the notification message may include receiving at least a generic notification message part or an application-specific notification message part or a media object.

In one embodiment, the first channel is an interactive channel and the second channel is a broadcast channel.

In another aspect, the invention relates to a computer program product, embodied in a computer-readable medium, comprising computer code configured to implement the above-described processes.

In another aspect, the invention relates to an apparatus comprising a processor and a memory unit communicatively connected to the processor. The memory unit includes computer code for receiving at least an indication of a notification message through a first channel and computer code for receiving at least a part of the notification message through a second channel.

In another aspect of the invention, an apparatus includes means for receiving at least an indication of a notification message through a first channel and means for receiving at least a part of the notification message through a second channel.

These and other advantages and features of various embodiments, together with the organization and manner of operation thereof, will become apparent from the following detailed description when taken in conjunction with the accompanying drawings, wherein like elements have like numerals throughout the several drawings described below.

BRIEF DESCRIPTION OF THE DRAWINGS

Embodiments of the invention are described by referring to the attached drawings, in which.

DETAILED DESCRIPTION OF VARIOUS EMBODIMENTS

Figure 1:
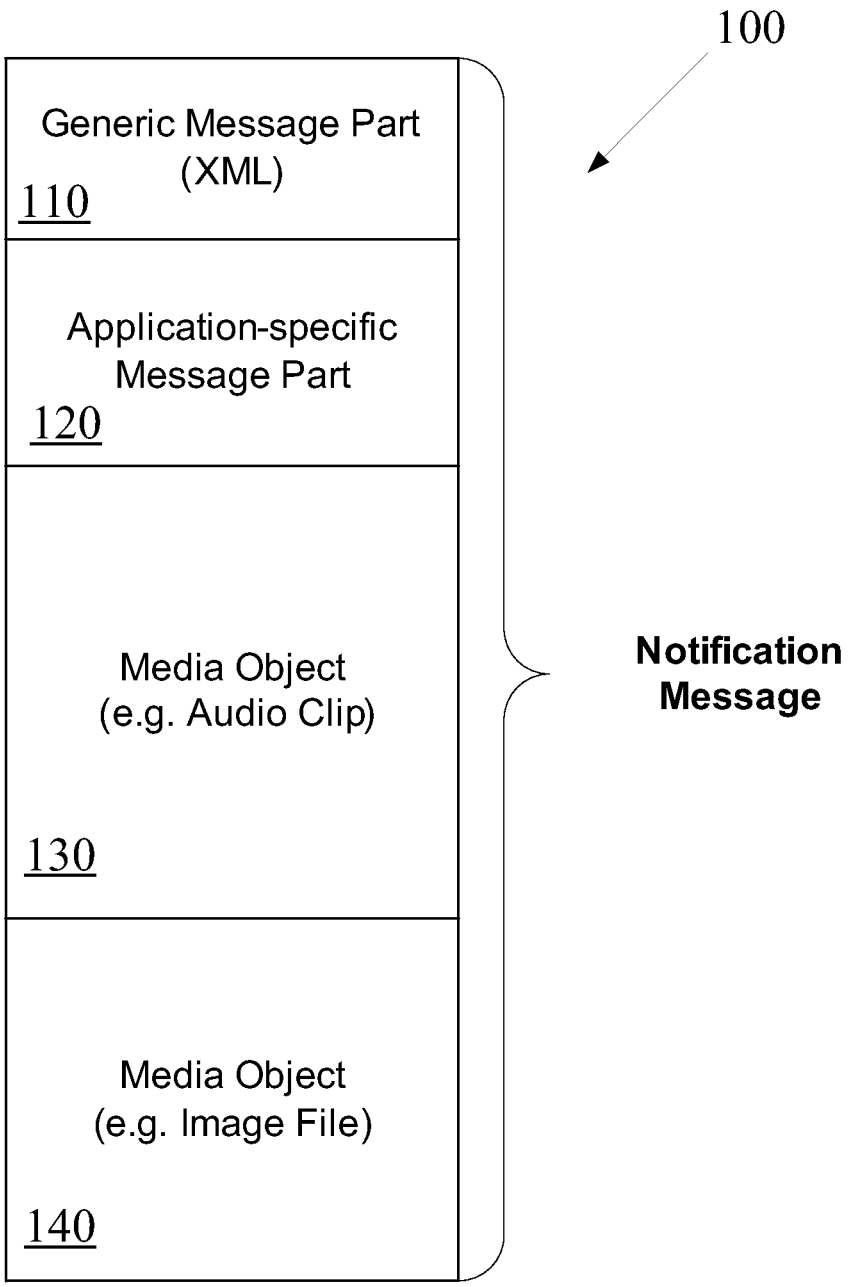
FIG. 1 illustrates the structure of an exemplary notification message.

A notification message may be composed of multiple parts. FIG. 1 illustrates the structure of an exemplary notification message. The exemplary notification message 100 includes a generic message part 110. The generic message part 110 may be an XML fragment that contains generic information about the notification message. This generic information is consumed by the notification framework.

The notification message 100 further includes an application-specific message part 120. The application-specific message part 120 is a fragment (typically in XML format) that contains the information to describe the content of the notification message. The application-specific message part 120 is consumed by an application capable of processing the application-specific message part 120 of the notification message 100.

The notification message 100 may also include one or more media objects, such as an audio clip 130 and an image file 140. The media objects may include other components as well, such as video files, for example. The media objects constitute part of the notification message.

During the lifetime of a notification message, its parts and updates thereof may be delivered separately or some parts may be omitted completely. In one example, a notification message carries a command for receivers to fetch the other message parts. Later, an update of the notification message may indicate that the previously fetched notification message is to be launched. In other cases, all parts of a notification message may be delivered as a single transport object by using the multipart/related MIME encapsulation. This encapsulation enables the aggregation of multiple notification messages in a single notification message, while still providing access to each single message part separately.

Two different transport protocols, such as Real-time Transport Protocol (RTP) and File Delivery over Unidirectional Transport (FLUTE), may be used for the delivery of notification messages. FLUTE may be used for the delivery of un-synchronized and default notification messages, while RTP may be used mainly for the delivery of synchronized, service-related notification messages. Alternatively, a combination of RTP and FLUTE may be used such that the bulky payload of a notification message (e.g., application-specific message part and media objects, if any) can be transported using FLUTE, while only the generic message part of the notification message is delivered using RTP.

For RTP delivery, an RTP payload format header has been defined to indicate the important information that enables the correct processing and extraction of the notification message. The payload format header also allows for filtering of notification messages based on, for example, their notification type. Additionally, the payload format header provides the functionality for fragmentation and re-assembly of notification messages that exceed the maximum transmission unit (MTU) size.

A similar extension to the File Delivery Table (FDT) of FLUTE has been defined to provide identification and fast access to information fields that are necessary for selection of notification messages. The notification message parts may then be encapsulated and carried as a single transport object or as separate transport objects. The generic message part typically provides a list of the message parts that constitute the corresponding notification message. This will enable the notification framework to retrieve all parts of a notification message and make them available to the consuming notification application. The references to the media objects as well as the description of the way to use them are typically provided by the application-specific message part. However, as the application-specific message part is not read by the notification framework, significant delays for reconstructing the notification message may occur if the notification framework is not aware of all the message parts to be retrieved.

Currently the Internet Protocol Datacast (IPDC) notification framework does not define the mechanisms for delivery notification messages over the interactive channel. Broadcast delivery is not always possible. For example, the terminal may not tuned to the DVB-H network or no DVB-H coverage may be available. In this regard, interactive channel delivery can be a key component of the notification framework.

In accordance with embodiments of the present invention, a mechanism for delivering notification messages over the interactive channel is provided. An interactive channel for notification message delivery may be discovered through an indication of the type of the channel and a link to access the channel.

In accordance with embodiments of the present invention, two different types of delivery over the interactive channel are made available, push and poll.

Figure 2:
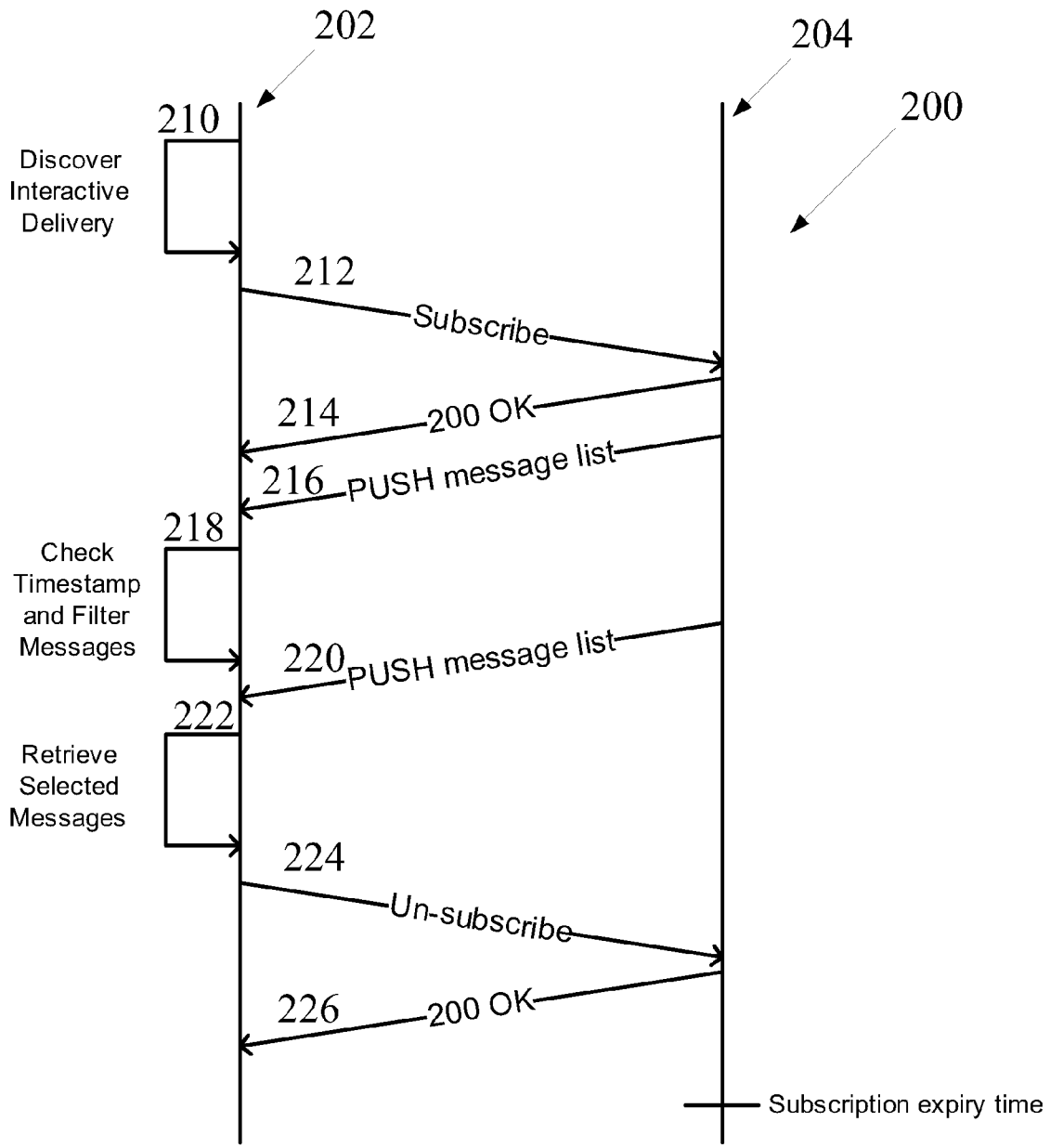
FIG. 2 illustrates an exemplary notification message delivery in accordance with one embodiment of the present invention.

In accordance with one embodiment, a push type delivery is provided. FIG. 2 illustrates an exemplary notification message delivery 200 using push-type delivery. In the illustrated embodiment, the receiver first discovers interactive delivery (step 210). This discovery process is described in further detail below. The receiver sends a "subscribe" request (step 212) and receives a 200 OK message (step 214). Subsequently, the notification message, or a part of it, is pushed to the receiver (step 216). In the embodiment illustrated in FIG. 2, for improved efficiency, the message part pushed to the receiver in step 216 may only contain an indication about the availability of messages in a message list. The sender pushes the message list to the receiver periodically or whenever new messages are available, as indicated by the pushing of the message list in step 220. The receiver 202 may filter the messages to determine if any messages need to be retrieved (step 218). Then, the receiver retrieves selected messages in a pull-type procedure (step 222). The receiver 202 then transmits an "un-subscribe" request (step 224) and receives a 200 OK message (step 226) to complete the transaction.

Figure 3:
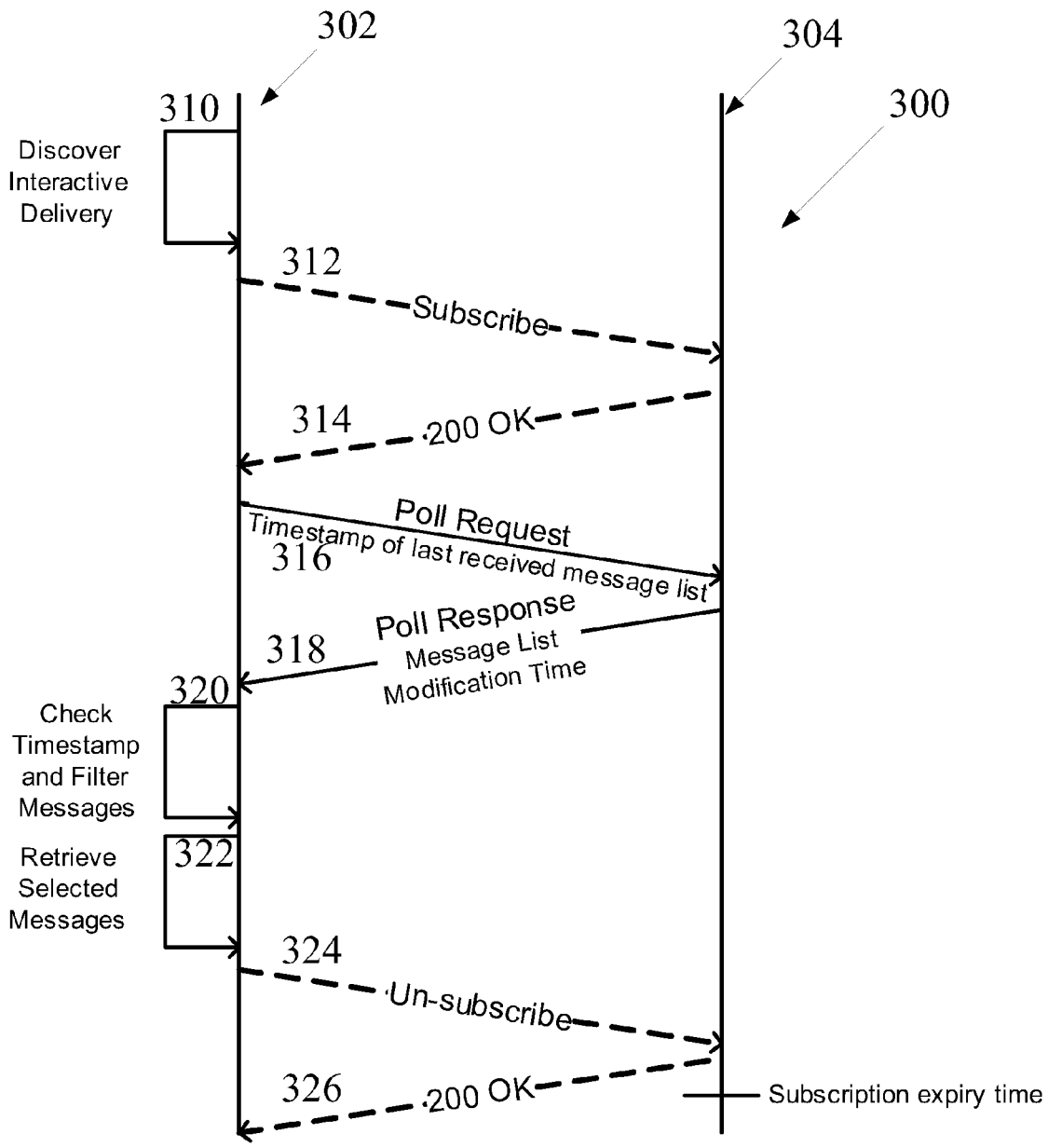
FIG. 3 illustrates an exemplary notification message delivery in accordance with another embodiment of the present invention.

In accordance with another embodiment, a poll type delivery is provided. FIG. 3 illustrates an exemplary notification message delivery 300 using poll-type delivery. In accordance with a poll-type delivery, the receiver periodically checks whether new notification messages of interest are available for reception. In the illustrated embodiment, the receiver 302 first discovers interactive delivery (step 310). The receiver sends a "subscribe" request (step 312) and receives a 200 OK message (step 314). The receiver 302 then transmits a periodic poll request (step 316) and receives a poll response (step 318). The poll response may include a list of available messages together with necessary information to enable selection and filtering, such as a modification time stamp. The receiver 302 may then filter the messages to determine if any messages need to be retrieved (step 320). Then, the receiver retrieves selected messages in a pull-type procedure (step 322). The receiver 302 then transmits an "un-subscribe" request (step 324) and receives a 200 OK message (step 326) to complete the transaction.

Thus, the delivery is split into two different steps. In the first step the message list is received and filtering is performed to select the messages that are new and of interest to the terminal or user. In the second step, the retrieval of the message parts is performed. In accordance with embodiments of the present invention, the two steps are decoupled and the delivery channels used may differ. For example, the message list may be polled from the service, and the notification messages of interest may be subsequently received over the broadcast channel. During the first step, as little data as possible is exchanged. This improves the performance and scalability.

One implementation of the embodiments of the present invention is provided below. A terminal discovers that a notification service is delivered over the interactive channel. If the user/terminal wants to receive the messages, a subscription procedure is performed (if necessary). Depending on the type of delivery, push or poll, the terminal receives a list of new notification messages that are available for consumption. The terminal is also informed about the type of message retrieval, which can be over broadcast or over interactive channel. In the case of broadcast, the terminal tunes to the broadcast channel and retrieves the messages. In the case of the interactive channel, the terminal requests the set of selected notification messages and receives them over the interactive channel.

The notification framework defines two different classes of notification channels: (1) default notification channels and (2) user-selected notification services.

Default notification channels deliver generic notification messages (not selected by the user). Three following default notification channels are defined: (a) network default notification (NDN) channel, (b) platform default notification (PDN) channel, and (c) ESG default notification (EDN) channel. Default notification channels are discovered via the DVB-H bootstrap session.

User-selected notification services deliver notification messages that are part of a service that has been selected by the user. These notification services are discovered through the Electronic Service Guide (ESG).

An implementation of an embodiment of the present invention defines extensions to the discovery mechanisms in order to indicate the type of the delivery, broadcast or interactive channel, poll or push, as well as the access information that in some embodiments may be a URL of the server to be used for polling operations to the receiver.

An implementation of the changes to the discovery mechanisms in accordance with embodiments is described below.

Changes to the Bootstrap Signaling

Default notification channels may be discovered through a dedicated descriptor (e.g., the DefaultNotificationAccessDescriptor) in the ESG bootstrap channel. The changes to the descriptor enable the signaling of the type of the delivery channel and the information necessary to access the channel.

One embodiment is given by the following table:

| | | |
|---|---|---|
| DefaultNotificationAccessDescriptor { | | |
| n_o_PDNEntries | 8 | uimsbf |
| n_o_EDNEntries | 8 | uimsbf |
| for (i=0;i<n_o_PDNEntries;i++){ | | |
| PDNEntry( ) | | |
| } | | |
| for (i=0;i< n_o_EDNEntries;i++){ | | |
| EDNEntry[i]( ) | | |
| } | | |
| } | | |

Here, the 'DefaultNotificationAccessDescriptor' is modified to enable the indication of multiple platform default notification (PDN) channels. Further changes are introduced to the definition of PDNEntry and EDNEntry to indicate the type of the channel and how to access it. The 'DefaultNotificationAccessDescriptor' specifies the acquisition information related to current IP platform or a particular electronic service guide provider identification 'ESGProviderID' that is signaled in an electronic service guide provider discovery descriptor. In the exemplary table the entry 'n_o_PDNEntries' indicates the number of PDN entries in the current descriptor. In one embodiment at most one indicator per channel is allowed. Correspondingly the entry 'n_o_EDNEntries' specifies the number of EDN entries for which access information of EDN services are signaled.

| Syntax | No. of bits | Mnemonic |
|---|---|---|
| PDNEntry{ | | |
| PDNEntryversion | 8 | uimsbf |
| EntryLength | 8+ | vluimsbf8 |
| ChannelType | 8 | uimsbf |
| If (ChannelType == 1) { | | |
| IPVersion6 | 1 | bslbf |
| Reserved | 7 | bslbf |
| If(IPVersion6){ | | |
| SourceIPAddress | 128 | bslbf |
| DestinationIPAddress | 128 | bslbf |
| }else{ | | |
| SourceIPAddress | 32 | bslbf |
| DestinationIPAddress | 32 | bslbf |
| } | | |
| Port | 16 | uimsbf |
| TSI | 16 | uimsbf |
| } else if (ChannelType == 2 \|\| ChannelType == | | |

-continued

| Syntax | No. of bits | Mnemonic |
|---|---|---|
| 3) { | | |
| AccessURLLength | 8 | uimsbf |
| For (i=0; i<AccessURLLength;i++) { | | |
| AccessURL_char | 8 | uimsbf |
| } | | |
| } | | |
| if (ChannelType == 3) { | | |
| PollInterval | 32 | uimsbf |
| } | | |
| } | | |

| Syntax | No. of bits | Mnemonic |
|---|---|---|
| EDNEntry{ | | |
| EDNEntryVersion | 8 | uimsbf |
| EntryLength | 8+ | vluimsbf8 |
| ProviderID | 16 | uimsbf |
| ChannelType | | |
| If (ChannelType==1) { | | |
| IPVersion6 | 1 | bslbf |
| Reserved | 7 | bslbf |
| If(IPVersion6){ | | |
| SourceIPAddress | 128 | bslbf |
| DestinationIPAddress | 128 | bslbf |
| }else{ | | |
| SourceIPAddress | 32 | bslbf |
| DestinationIPAddress | 32 | bslbf |
| } | | |
| Port | 16 | uimsbf |
| TSI | 16 | uimsbf |
| } else if (ChannelType == 2 \|\| ChannelType == | | |
| 3) { | | |
| AccessURLLength | 8 | uimsbf |
| For (i=0; i<AccessURLLength;i++) { | | |
| AccessURL_char | 8 | uimsbf |
| } | | |
| } | | |
| if (ChannelType == 3) { | | |
| PollInterval | 32 | uimsbf |
| } | | |
| } | | |

As described above, three different channel types are defined. The meaning of each type is described in the following table:

| Type | Description |
|---|---|
| 1 | Broadcast delivery |
| 2 | Push delivery over the interactive channel |
| 3 | Poll delivery over the interactive channel |

For the push and poll delivery, a URL to the service is provided. The URL, 'AccessURL_char', is encoded as a UTF-8 string, preceded by a length indication 'AccessURLLength'. In case of a poll delivery, an indication of the minimum interval between two consecutive poll requests 'PollInterval' is provided. The minimum interval may be expressed in seconds.

Another implementation of the signaling of interactive delivery of default notification channels in accordance with an embodiment of the present invention is to define a new access descriptor in XML format. This access descriptor is identified based on its MIME type, which can be e.g. "application/vnd.dvb.notif.default-interactive+xml". The XML schema of the new access descriptor can be as follows:

```
<?xml version="1.0" encoding="UTF-8"?>
    <xs:schema xmlns:xs="http://www.w3.org/2001/XMLSchema"
        xmlns:fl="dvb:ipdc:2007:notification"
        elementFormDefault:xs="qualified"
        targetNamespace:xs=" dvb:ipdc:2007:notification:interactive">
     <xs:element name="DefaultNotificationOverInteractive"
type="DefaultNotificationOverInteractiveType"/>
     <xs:complexType name="DefaultNotificationOverInteractiveType">
        <xs:sequence>
            <xs:any namespace="##any" processContents="lax"/>
        </xs:sequence>
        <xs:attribute name="AccessURL" type="xs:anyURI" usage="required"/>
        <xs:attribute name="ChannelType" type="ChannelTypeType"
usage="required"/>
        <xs:attribute name="PollInterval" type="xs:unsignedInteger" usage="optional"/>
        <xs:attribute name="RegistrationRequired" type="xs:bool" usage="optional"
default="true"/>
        <xs:attribute name="ProviderID" type="xs:unsignedInteger" usage="optional"/>
        <xs:anyAttribute namespace="##any" processContents="lax"/>
    </xs:complexType>
    <xs:simpleType name="ChannelTypeType">
        <xs:restriction base="xs:string">
            <xs:enumeration value="BroadcastDelivery"/>
            <xs:enumeration value="PushDelivery"/>
            <xs:enumeration value="PollDelivery"/>
        </xs:restriction>
</xs:simpleType>
</xs:schema>
```

Changes to the Signalling in the ESG

User-selected notification services are discovered from the ESG through an indication in the Acquisition Fragment. A service fragment describes the notification component or service that is identified by a certain notification type. The 'AcquisitionRef' element of the ScheduleEvent fragment is extended to include the description of the notification component or service and the delivery channel of the notification messages of that type.

In order to indicate that the messages are delivered over the interactive channel, a modification of the mapping between notification service or component and the delivery channel is needed. This change is more appropriate in the 'ExtAcquisitionRefType' element of the ScheduleEvent fragment. A possible implementation is shown in the following schema:

In the above exemplary implementation, the schedule event fragment may contain a reference to an interactive channel for the delivery of the notification messages. The AccessURL is the URL to the interactive delivery service and can be, for example, an HTTP URL. The ChannelType indicates the type of the delivery channel. In case of a poll-type delivery, the PollInterval may be used to indicate the interval between two consecutive poll operations. The SubscriptionRequired information field indicates whether the terminal should first send a subscription request before starting the reception. Poll delivery may always require a subscription. In case of delivery over the interactive channel, wherein the type of the channel 'ChannelType' is either push delivery or poll delivery, the ComponentIDRef may still be used to indicate the FLUTE channel over which the actual message parts are delivered. This allows the receiver and sender to select the optimal way for retrieving the message parts. The interactive channel may then e.g. be used to just

```
<complexType name="ExtAcquisitionRefType">
        <xs:complexContent>
        <extension base="esg:AcquisitionRefType"/>
        <xs:sequence>
            <element name="ComponentIDRef" type="anyURI" minOccurs="0"
maxOccurs="unbounded"/>
        </xs:sequence>
            <xs:attribute name="AccessURL" type="xs:anyURI" usage="optional"/>
            <xs:attribute name="ChannelType" type="ChannelTypeType"
usage="optional" default="BroadcastDelivery"/>
            <xs:attribute name="PollInterval" type="xs:unsignedInteger"
usage="optional"/>
            <xs:attribute name="SubscriptionRequired" type="xs:bool" usage="optional"
default="true"/>
        </extension>
        </xs:complexContent>
</complexType>
    <xs:simpleType name="ChannelTypeType">
        <xs:restriction base="xs:string">
            <xs:enumeration value="BroadcastDelivery"/>
            <xs:enumeration value="PushDelivery"/>
            <xs:enumeration value="PollDelivery"/>
        </xs:restriction>
    </xs:simpleType>
```

signal the existence of new notification messages but not for the retrieval of the message.

Subscription Procedure

A subscription procedure is defined in order to enable the service provider to keep track of the consumers of a specific notification service. The procedure is mandatory in the case of push-type delivery over the interactive channel. However, it can also be used for other types of delivery, such as, for example, the broadcast delivery. In the case of broadcast delivery, the subscription is optional for the terminal. Thus, the terminal may still consume the service without subscription.

In case of a poll delivery, wherein the type of the channel is poll delivery or whenever the server requests a subscription, the terminal has to perform a subscription procedure. The subscription procedure is performed using HTTP 1.1 POST request/response messages. The request is directed to the URL indicated by the AccessURL indicated in the discovery process. The body of the request contains the information necessary for the request. The MIME type of the request is in one embodiment "application/vnd.dvb.notif-subscription-request+xml".

The subscription procedure may be performed using HTTP or HTTPS. The terminal indicates its address and identification, such as the MSISDN number, to the service provider. It also indicates the nature of the operation, subscription or un-subscription operation. Further the request may comprise a reference to the ESG service. The request is directed to the AccessURL information field that is discovered as described in the previous section.

The following is an example of an HTTP POST request for the purpose of registration:

```
POST
http://www.example.com/notification/interactive.cgi?notification_type=232
HTTP/1.1
From: user@ipdc.com
User-Agent: Notification Framework/1.0
Content-Type: application/vnd.dvb.notif-subscription-request+xml
Content-Length: 205
<?xml version="1.0" encoding="UTF-8"?>
<NotificationSubscriptionRequest>
    <Operation>Subscribe</Operation>
    <DeliveryMethod>PollDelivery</DeliveryMethod>
    <DeviceAddress type="MSISDN">358654231561</DeviceAddress>
    <DeviceID type="IMEI">53412165451</DeviceID>
    <ServiceRef>service:5623</ServiceRef>
</NotificationSubscriptionRequest>
```

The XML schema of the request body in one embodiment is described in the following table:

```
<?xml version="1.0" encoding="UTF-8"?>
    <xs:schema xmlns:xs="http://www.w3.org/2001/XMLSchema"
            xmlns:fl="dvb:ipdc:2007:notification"
            elementFormDefault:xs="qualified"
            targetNamespace:xs="
            dvb:ipdc:2007:notification:interactive">
        <xs:sequence>
            <xs:element name="SubscriptionRequest"
type="SubscriptionRequestType" minOccurs="0" maxOccurs="1"/>
            <xs:element name="UnsubscriptionRequest"
type="UnsubscriptionRequestType" minOccurs="0" maxOccurs="1"/>
        <xs:any namespace="##any" processContents="lax"
        minOccurs="0"
maxOccurs="unbounded"/>
        </xs :sequence>
    <xs:complexType name="SubscriptionRequestType">
```

-continued

```
            <xs:sequence>
                <xs:element name="DeviceAddress" minOccurs="1">
                    <xs:comlexContent>
                        <xs:extension base="xs:string">
                            <xs:attribute name="Type"
type="DeviceAddressType" usage="required"/>
                        </xs:extension>
                    </xs:complexContent>
                <xs:element name="DeviceID" minOccurs="0">
                    <xs:complexContent>
                        <xs:extension base="xs:string">
                            <xs:attribute name="Type"
type="DeviceIDType" usage="required"/>
                        </xs:extension>
                    </xs:complexContent>
                <xs:any namespace="##any" processContents="lax"/>
            </xs:sequence>
        <xs:attribute name="ChannelType" type="ChannelTypeType"
usage="required"/>
        <xs:attribute name="ESGService" type="xs:anyURI"
usage="optional"/>
        <xs:anyAttribute namespace="##any" processContents="lax"/>
    </xs:complexType>
    <xs:complexType name="UnsubscriptionRequestType">
        <xs:sequence>
            <xs:any namespace="##any" processContents="lax"/>
        </xs:sequence>
        <xs:attribute name="SubscriptionID" type="xs:unsignedInteger"
usage="required"/>
    </xs:complexType>
    <xs:simpleType name="DeviceAddressType">
        <xs:restriction base="xs:string">
            <xs:enumeration value="MSISDN"/>
        </xs:restriction>
    </xs:simpleType>
    <xs:simpleType name="DeviceIDType">
        <xs:restriction base="xs:string">
```

-continued

```
            <xs:enumeration value="IMEI"/>
        </xs:restriction>
    </xs:simpleType>
    </xs:schema>
```

As can be seen from the above example, the subscription request may include the following information:

AccessURI containing the necessary information to uniquely identify the notification service. The service provider should make sure that this is possible when creating the AccessURI and signalling it to the terminals;

MIME type of the body of the message indicates that this is a notification subscription request;

Operation indicates whether this is a subscription or an un-subscription request Type of delivery that is anticipated by the terminal. If the delivery is selected to be the PUSH delivery, then the service provider registers the device for push message delivery;

A subscription ID that is used to un-subscribe;

Device address that will be used e.g. for push type delivery; and

Device Identifier

The response to a successful request is an HTTP(S) 200 OK message and includes a subscription identifier. The following is an example of a subscription response message:

```
HTTP/1.1 200 OK
Content-Type: application/vnd.dvb.notif-subscription-response+xml
<?xml version="1.0" encoding="UTF-8" ?>
<NotificationSubscriptionResponse>
<Operation>Subscribe</Operation>
<SubscriptionID>2168471</SubscriptionID>
</NotificationSubscriptionResponse>
```

The XML schema of the subscription response in one embodiment is given in the following table:

```
<?xml version="1.0" encoding="UTF-8"?>
    <xs:schema xmlns:xs="http://www.w3.org/2001/XMLSchema"
            xmlns:fl="dvb:ipdc:2007:notification"
            elementFormDefault:xs="qualified"
            targetNamespace:xs="
            dvb:ipdc:2007:notification:interactive">
        <xs:sequence>
            <xs:element name="SubscriptionResponse"
type="SubscriptionResponseType" minOccurs="0" maxOccurs="1"/>
            <xs:element name="UnsubscriptionResponse"
type="UnsubscriptionRespnse" minOccurs="0" maxOccurs="1"/>
        <xs:any namespace="##any" processContents="lax"
        minOccurs="0"
maxOccurs="unbounded"/>
        </xs :sequence>
    <xs:complexType name="SubscriptionResponseType">
            <xs:sequence>
                <xs:any namespace="##any" processContents="lax"/>
            </xs:sequence>
        <xs:attribute name="SubscriptionID" type="xs:unsignedInteger"
usage="required"/>
        <xs:anyAttribute namespace="##any" processContents="lax"/>
    </xs:complexType>
    <xs:complexType name="UnsbuscriptionResponseType">
        <xs:sequence>
            <xs:any namespace="##any" processContents="lax"/>
        </xs:sequence>
        <xs:attribute name="SubscriptionID" type="xs:unsignedInteger"
usage="required"/>
    </xs:complexType>
```

The subscription id is used for subsequent operations on the subscription, for example, the un-subscription request. It may also be used for message filtering at the receiver.

Message List

For the delivery of notification messages over the interactive channel, a list that indicates the available notification messages is provided. The list informs the terminal about the availability of new notification messages. The list includes the necessary information for the terminal to decide whether 1) the message is of interest or not; 2) the message has not been seen by the terminal already; and 3) the mechanism and/or location for retrieval of the message or parts thereof.

As a consequence, the following fields are included in the message list:

Filtering information of the message: notification type, message id, message version, other filtering information;

URL to retrieve the message or if e.g. not present, the retrieval is done over the broadcast channel;

Timestamp of the last modification to the current message list; and

Polling interval is used to update the polling period of the receiver.

In one embodiment the message may use "application/vnd.dvb.notif-message-list+xml" as the MIME type and may conform to the following XML structure:

```
<?xml version="1.0" encoding="UTF-8"?>
    <xs:schema xmlns:xs="http://www.w3.org/2001/XMLSchema"
            xmlns:fl="dvb:ipdc:2007:notification"
            elementFormDefault:xs="qualified"
            targetNamespace:xs="
            dvb:ipdc:2007:notification:interactive">
    <xs:element name="NotificationMessageListType">
        <xs:complexType>
            <xs:sequence>
                <xs:element name="NotificationMessageDescription"
type="NotificationMessageDescriptionTyp" minOccurs="1"
maxOccurs="unbounded"/>
                <xs:any namespace="##any" processContents="lax"/>
            </xs:sequence>
            <xs:attribute name="LastModified"
            type="xs:unsignedInteger"
usage="required"/>
            <xs:anyAttribute namespace="##any"
            processContents="lax"/>
        </xs:complexType>
        <xs:complexType name="NotificationMessageType">
                <xs:element name="NotificationMessageDescription"
type="NotificationMessageDescriptionTyp" minOccurs="1"/>
                <xs:element name="RetrievalURL>
                    <xs:complexContent>
                        <xs:extension base="xs:anyURI"/>
                            <xs:attribute
name="RetrievalChannel" type="RetrievalChannelType"
default="Broadcast"/>
                        </xs:extension>
                    </xs:complexContent
                </xs:element>
        </xs:complexType>
```

The terminal first checks whether the message list contains new messages by comparing its modification timestamp to the timestamp of the last received message list. If it is more recent, the message list is checked to find out any messages of interest. If a notification message is found to be of interest, the terminal checks how to retrieve the message and performs the retrieval.

Figure 4:
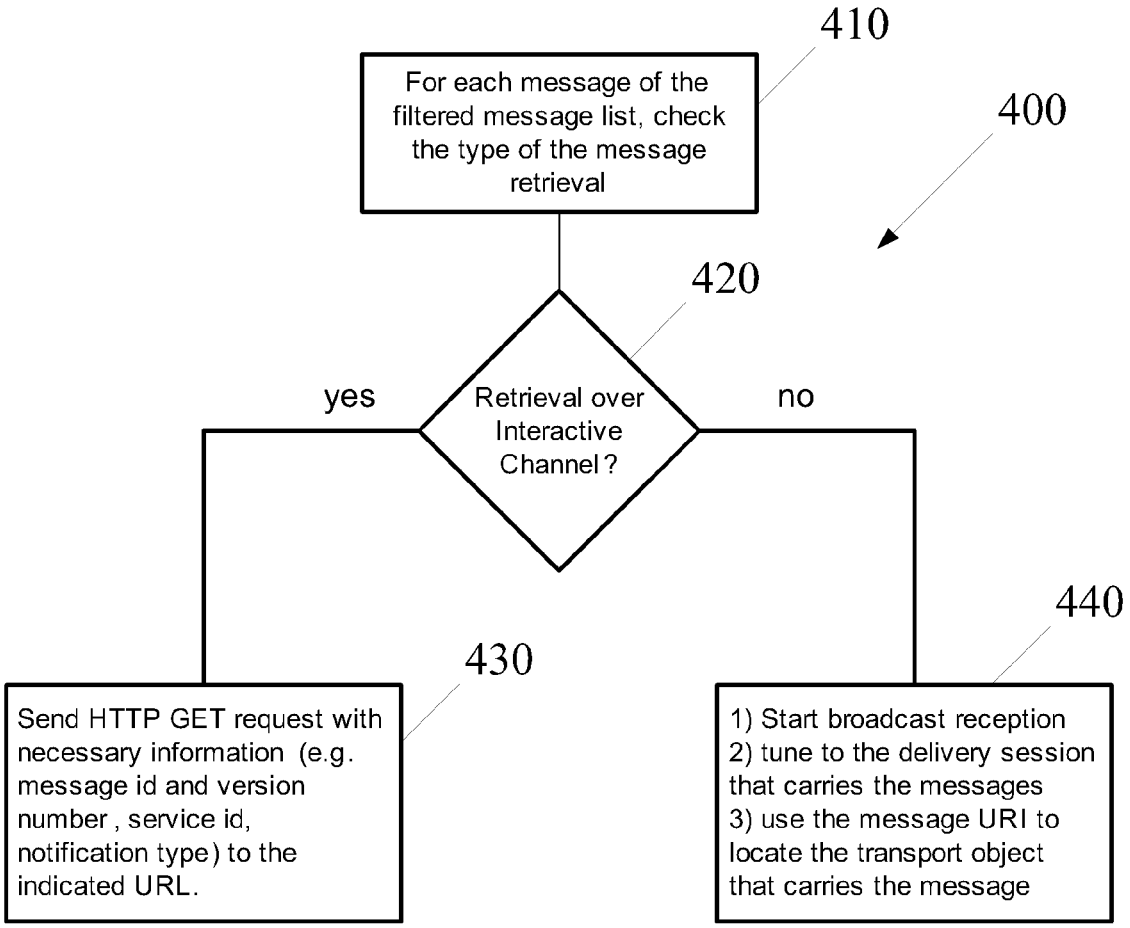
FIG. 4 is a flow chart illustrating message retrieval in accordance with an embodiment of the present invention.

Reference is now made to FIG. 4, which illustrates a flow chart illustrating message retrieval in accordance with an embodiment of the present invention. At block 410, each message of the filtered message list is checked to deter the type of message retrieval dictated. At block 420, it is determined whether the retrieval is to be over an interactive channel. If, at block 420, the determination is made that the retrieval is to be over an interactive channel, the method proceeds to block 430 and, as described below, an HTTP GET request is sent to the indicated URL. On the other hand, if the determination at block 420 is made that the retrieval is not to be over an interactive channel, the method proceeds to block 440 and, broadcast reception is initiated.

Figure 5:
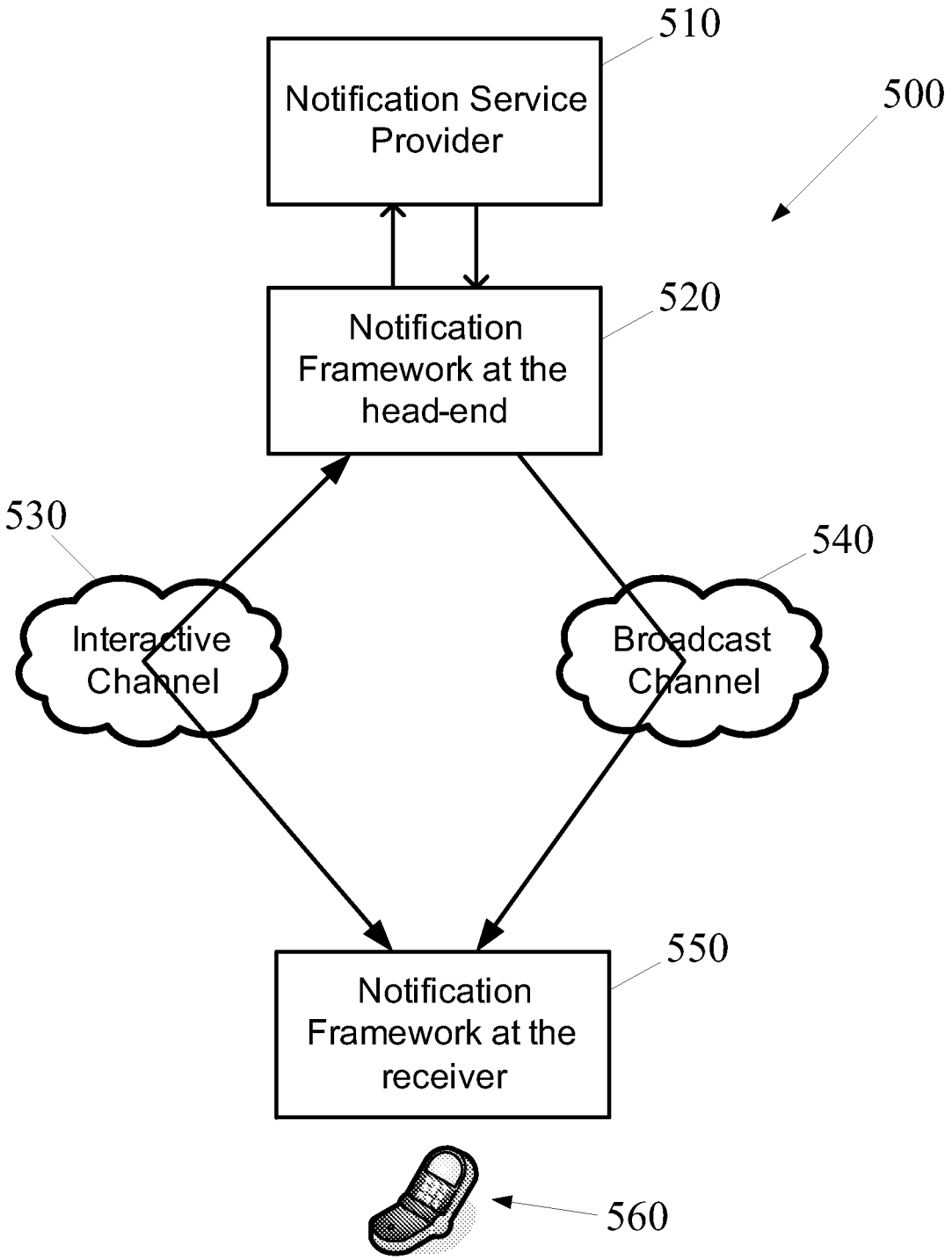
FIG. 5 is a block diagram illustrating an exemplary architecture for interactive notification delivery in accordance with an embodiment of the present invention.

Reference is now made to FIG. 5, which provides a block diagram illustrating an exemplary architecture for interactive notification delivery in accordance with an embodiment of the present invention. The architecture 500 includes a notification service provider 510 coupled to communicate with the head end 520 of the notification framework. The head end 520 of the notification framework may communicate with a corresponding receiver end 550 of the notification framework through either the interactive channel 530 or the broadcast channel 540. The receiver end 550 of the notification framework can then provide notification messages to the user 560.

Push Message Delivery

When subscribing to a notification service, the terminal may indicate the type of delivery it wants to have. If the delivery type is supported by the service provider, the subscription is performed. For the push delivery, the terminal registers as a receiver and provides its address. The service provider adds the terminal to its distribution list. In one embodiment the push delivery is performed on need basis, for example, when a certain amount of new notification messages becomes available, in another embodiment it may be done periodically.

The push delivery may be performed, for example, using OMA PUSH OTA. An application ID is assigned for the notification delivery according to the IPDC notification framework. Either OTA-WSP or OTA-HTTP may be used.

Poll Message Delivery

In the case the notification service is available over poll-type delivery channel, the terminal may periodically check for the latest message list using the AccessURL of the notification service. The period may be according to the indication of the service provider.

HTTP GET may be used for requesting the message list. The If-Modified-Since header field may be used to indicate the date of the last correctly received message list. This will enable the service provider to check if there is need to send the message list or not, which will help reduce the network traffic by only sending a message list when not already seen by the receiver. In case the message list has not been modified since the last access, the 304 HTTP response code is used.

The service provider may overwrite the polling period to improve its performance and to optimally use the network bandwidth.

Message Retrieval

After processing the message list, the notification messages of interest are retrieved by using the URL delivered in the message list. The service provider may indicate that the retrieval is done using the broadcast channel, in that case the terminal tunes in to the corresponding broadcast channel and retrieves the message based on its identifiers (e.g., message id and version number or URL to the container of the message).

Figure 6:
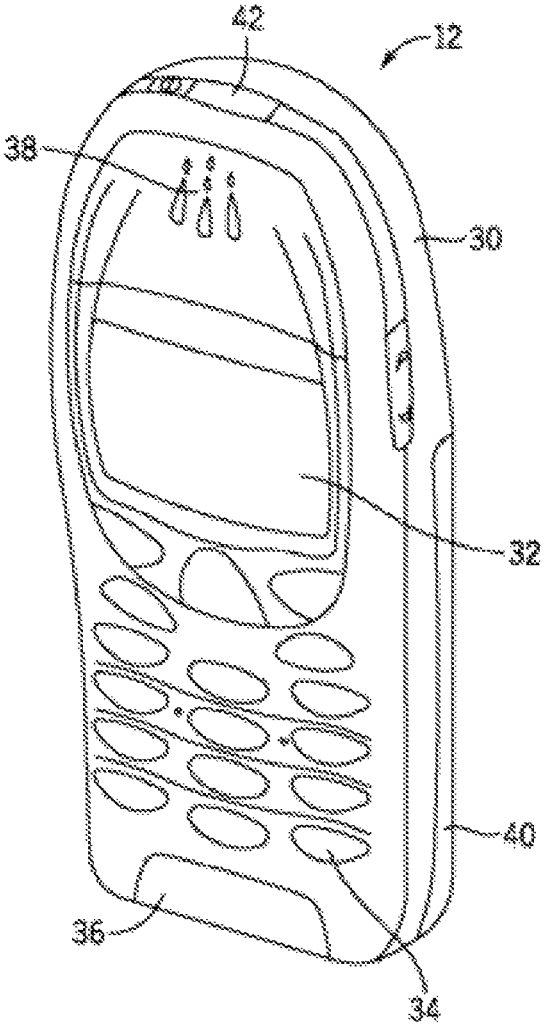
FIG. 6 is a perspective view of an electronic device that can be used in conjunction with the implementation of various embodiments of the present invention.
Figure 7:
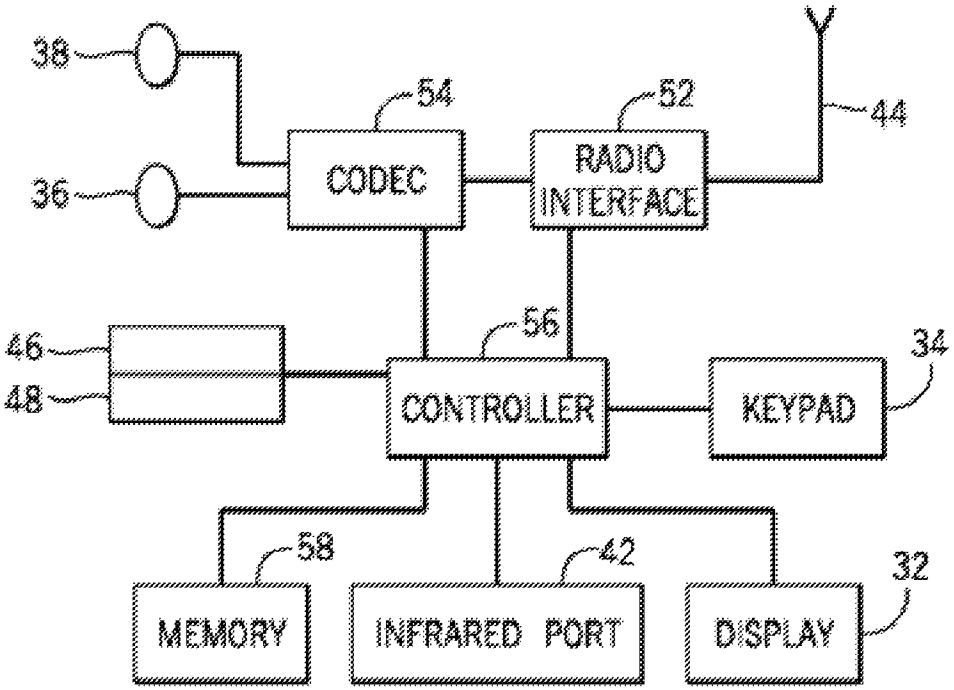
FIG. 7 is a schematic representation of the circuitry which may be included in the electronic device of FIG. 6.

FIGS. 6 and 7 show one representative mobile device 12 within which the present invention may be implemented. It should be understood, however, that the present invention is not intended to be limited to one particular type of electronic device. The mobile device 12 of FIGS. 6 and 7 includes a housing 30, a display 32 in the form of a liquid crystal display, a keypad 34, a microphone 36, an ear-piece 38, a battery 40, an infrared port 42, an antenna 44, a smart card 46 in the form of a UICC according to one embodiment of the invention, a card reader 48, radio interface circuitry 52, codec circuitry 54, a controller 56 and a memory 58. Individual circuits and elements are all of a type well known in the art, for example in the Nokia range of mobile telephones.

The various embodiments of the present invention described herein is described in the general context of method steps or processes, which may be implemented in one embodiment by a computer program product, embodied in a computer-readable medium, including computer-executable instructions, such as program code, executed by computers in networked environments. Generally, program modules may include routines, programs, objects, components, data structures, etc. that perform particular tasks or implement particular abstract data types. Computer-executable instructions, associated data structures, and program modules represent examples of program code for executing steps of the methods disclosed herein. The particular sequence of such executable instructions or associated data structures represents examples of corresponding acts for implementing the functions described in such steps or processes.

Software and web implementations of various embodiments of the present invention can be accomplished with standard programming techniques with rule-based logic and other logic to accomplish various database searching steps or processes, correlation steps or processes, comparison steps or processes and decision steps or processes. It should be noted that the words "component" and "module," as used herein and in the following claims, is intended to encompass implementations using one or more lines of software code, and/or hardware implementations, and/or equipment for receiving manual inputs.

The foregoing description of embodiments of the present invention have been presented for purposes of illustration and description. The foregoing description is not intended to be exhaustive or to limit embodiments of the present invention to the precise form disclosed, and modifications and variations are possible in light of the above teachings or may be acquired from practice of various embodiments of the present invention. The embodiments discussed herein were chosen and described in order to explain the principles and the nature of various embodiments of the present invention and its practical application to enable one skilled in the art to utilize the present invention in various embodiments and with various modifications as are suited to the particular use contemplated.

What is claimed is:

1. A method, comprising:

receiving, through a first channel of a digital broadcast network, a list of notification messages that includes, for each of the notification messages indicated by the list, (i) an identifier, (ii) a notification type and (iii) a channel type indication that indicates a type of delivery for the notification message over the digital broadcast network;

determining, based on the notification type for a listed notification message indicated by the list, to receive the listed notification message;

determining, based on the channel type indication for the listed notification message, that the listed notification message is to be received through a second channel of the digital broadcast network; and receiving, through the second channel of the digital broadcast network, at least a part of the listed notification message based on the identifier for the listed notification message.

2. The method of claim 1, wherein the channel type indication for the listed notification message indicates that the listed notification message is to be delivered via a broadcast delivery of a first type, and wherein the method further comprises:

sending a message to indicate subscription for the list of notification messages; and receiving another listed notification message via a broadcast delivery of a second type.

3. The method of claim 1, wherein the channel type indication for the listed notification message indicates that the listed notification message is to be delivered based on a first type of delivery, and wherein the method further comprises:

sending a poll request and receiving an updated message list with a modification time stamp as a poll response; and receiving an additional listed notification message, which is indicated by the list or the updated message list, based on a second type of delivery in which existence of the additional listed notification message is signaled via an interactive channel but in which the additional listed notification message is received via a File Delivery over Unidirectional Transport (FLUTE) channel.

4. The method of claim 1, wherein the part of the listed notification message comprises at least one media object, and wherein the method further comprises:

causing consumption of the at least one media object as part of a service.

5. The method of claim 1, wherein the first channel is an interactive channel and the second channel is a broadcast channel.

6. An apparatus, comprising:

one or more processors; and memory storing executable instructions configured to, with the one or more processors, cause the apparatus to:

receive, through a first channel of a digital broadcast network, a list of notification messages that includes, for each of the notification messages indicated by the list, (i) an identifier, (ii) a notification type and (iii) a channel type indication that indicates a type of delivery for the notification message over the digital broadcast network;

determine, based on the notification type for a listed notification message indicated by the list, to receive the listed notification message;

determine, based on the channel type indication for the listed notification message, that the listed notification message is to be received through a second channel of the digital broadcast network; and receive, through the second channel of the digital broadcast network, at least a part of the listed notification message based on the identifier for the listed notification message.

7. The apparatus of claim 6, wherein the channel type indication for the listed notification message indicates that the listed notification message is to be delivered via a broadcast delivery of a first type, and wherein the executable instructions are configured to, with the one or more processors, cause the apparatus to:

send a message to indicate subscription for the list of notification messages; and receive another listed notification message via a broadcast delivery of a second type.

8. The apparatus of claim 6, wherein the channel type indication for the listed notification message indicates that the listed notification message is to be delivered based on a first type of delivery, and wherein the executable instructions are configured to, with the one or more processors, cause the apparatus to:

send a poll request and receive an updated message list with a modification time stamp as a poll response; and receive an additional listed notification message based on a second type of delivery in which existence of the additional listed notification message is signaled via an interactive channel but in which the additional listed notification message is received via a File Delivery over Unidirectional Transport (FLUTE) channel.

9. The apparatus of claim 6, wherein the part of the listed notification message comprises at least one media object, and wherein the executable instructions are configured to, with the one or more processors, cause the apparatus to cause consumption of the at least one media object as part of a service.

10. The apparatus of claim 6, wherein the first channel is an interactive channel and the second channel is a broadcast channel.

11. One or more non-transitory computer-readable media storing executable instructions configured to, when executed, cause an apparatus to at least:

receive, through a first channel of a digital broadcast network, a list of notification messages that includes, for each of the notification messages indicated by the list, (i) an identifier, (ii) a notification type and (iii) a channel type indication that indicates a type of delivery for the notification message over the digital broadcast network;

determine, based on the notification type for a listed notification message indicated by the list, to receive the listed notification message;

determine, based on the channel type indication for the listed notification message, that the listed notification message is to be received through a second channel of the digital broadcast network; and receive, through the second channel of the digital broadcast network, at least a part of the listed notification message based on the identifier for the listed notification message.

12. The one or more non-transitory computer-readable media of claim 11, wherein the channel type indication for the listed notification message indicates that the listed notification message is to be delivered based on a first type of delivery, and wherein the executable instructions are configured to, when executed, cause the apparatus to:

send a message to indicate subscription for the list of notification messages, and receive an additional listed notification message based on a second type of delivery in which existence of the additional listed notification message is signaled via an interactive channel but in which the additional listed notification message is received via a File Delivery over Unidirectional Transport (FLUTE) channel.

13. The one or more non-transitory computer-readable media of claim 11, wherein the channel type indication for the listed notification message indicates that the listed notification message is to be delivered via a broadcast delivery of a first type, and wherein the executable instructions are configured to, when executed, cause the apparatus to:

send a poll request and receive an updated message list with a modification time stamp as a poll response; and receive another listed notification message via a broadcast delivery of a second type.

14. The one or more non-transitory computer-readable media of claim 11, wherein the first channel is an interactive channel and the second channel is a broadcast channel.

15. The method of claim 1, wherein, for each of the notification messages indicated by the list, the channel type indication indicates whether the notification message is to be delivered over the digital broadcast network via a broadcast delivery, a push delivery or a poll delivery, wherein the first channel of the digital broadcast network is for the poll delivery or the push delivery, wherein the second channel of the digital broadcast network is for the broadcast delivery, and wherein the method further comprises determining whether a subscription is required for receiving the listed notification message.

16. The method of claim 1, wherein the method further comprises:

determining, based on the notification type for an additional listed notification message indicated by the list, to receive the additional listed notification message;

determining, based on the channel type indication for the additional listed notification message, that the additional listed notification message is to be received over a channel of the digital broadcast network assigned for push or poll delivery; and receiving, through the channel of the digital broadcast network assigned for push or poll delivery, at least a part of the additional listed notification message based on the identifier for the additional listed notification message.

17. The method of claim 1, wherein receiving at least the part of the listed notification message based on the identifier for the listed notification message comprises receiving the part of the listed notification message in response to a request for the listed notification message that includes the identifier for the listed notification message.

18. The method of claim 17, wherein the request comprises a Hypertext Transfer Protocol (HTTP) GET request.

* * * * *